US008113969B1

(12) United States Patent
Martin

(10) Patent No.: US 8,113,969 B1
(45) Date of Patent: Feb. 14, 2012

(54) MAGIC ARC

(75) Inventor: Michael Martin, Oakland, CA (US)

(73) Assignee: Michael Martin, Oakland, CA (US)

( * ) Notice: Subject to any disclaimer, the term of this patent is extended or adjusted under 35 U.S.C. 154(b) by 0 days.

(21) Appl. No.: 12/807,516

(22) Filed: Sep. 7, 2010

(51) Int. Cl.
*A63B 69/00* (2006.01)

(52) U.S. Cl. ..... 473/447; 473/422

(58) Field of Classification Search ..... 473/422, 473/433, 447, 472, 479, 482; 434/247, 248; D21/781
See application file for complete search history.

(56) References Cited

U.S. PATENT DOCUMENTS

| | | | | |
|---|---|---|---|---|
| 4,383,685 | A * | 5/1983 | Bishop | 473/450 |
| 4,565,527 | A * | 1/1986 | Burchett | 434/248 |
| 5,599,016 | A * | 2/1997 | Larkin | 473/448 |
| 5,665,016 | A * | 9/1997 | Burnett | 473/448 |
| 5,746,668 | A * | 5/1998 | Ochs | 473/433 |
| 5,833,556 | A * | 11/1998 | Ferrari | 473/448 |
| 6,312,349 | B1 * | 11/2001 | Roberts | 473/448 |
| 6,544,132 | B1 * | 4/2003 | Tvedt | 473/448 |
| 7,713,149 | B2 * | 5/2010 | Docherty | 473/447 |
| 7,850,552 | B2 * | 12/2010 | Marty et al. | 473/467 |
| 2005/0192126 | A1 * | 9/2005 | Remaklus | 473/447 |
| 2010/0160093 | A1 * | 6/2010 | MacArthur | 473/447 |

* cited by examiner

*Primary Examiner* — Mitra Aryanpour

(57) ABSTRACT

The purpose of the shooting aid is to provide the basketball player with a visual trajectory of the correct path from the free throw line to the basketball hoop. The unique Tubular Arc Guide design offers the basketball player one of the most effective methods to increase their ability to make a higher percentage of free throws.

4 Claims, 4 Drawing Sheets

MAGIC ARC

BACKGROUND OF THE INVENTION

Free throw shooting is a pivotal part of basketball. All levels of basketball from amateurs, professionals and championships are won and lost at the free throw line. The Magic Arc allows a basketball player to improve in this important area of the game.

The Magic Arc came to fruition from observing the mechanics of hundreds of players from different skill levels of basketball. The players who shoot a higher percentage from the free-throw line have more arcs on the ball.

The present device will give the basketball player an optimal line of sight to the basket from the free-throw line. With this device a basketball player could actually see the correct arc and the basketball at its apex to make the basket. The Magic Arc can also be used to help a basketball player to improve their mid range jump shot. Therefore, this This product is a dual purpose shooting aid.

BRIEF SUMMARY OF THE INVENTION

A basketball free-throw shooting aid that helps a basketball player to envision and increase his/her ability to develop a consistent shooting arc from the free throw line to the basketball hoop.

The Magic Arc is placed on the ground to stand directly in front of the free throw shooter. The vertical adjustable length pole is adjusted in height for the shooter's comfort. The next step is to attach the Tubular Are Guide to the front of the basketball rim. This will enable the shooter to develop a consistent shooting arc simply by shooting the basketball to follow the path of the Arc Guide in the direction of the basketball hoop.

The player has also the capability of placing The Magic Arc in different shooting spots around the perimeter of the key area. By applying the same concept as shooting free throws but instead shoots mid range jump shots.

DESCRIPTION OF THE PREFERRED EMBODIMENT

Figure 1:
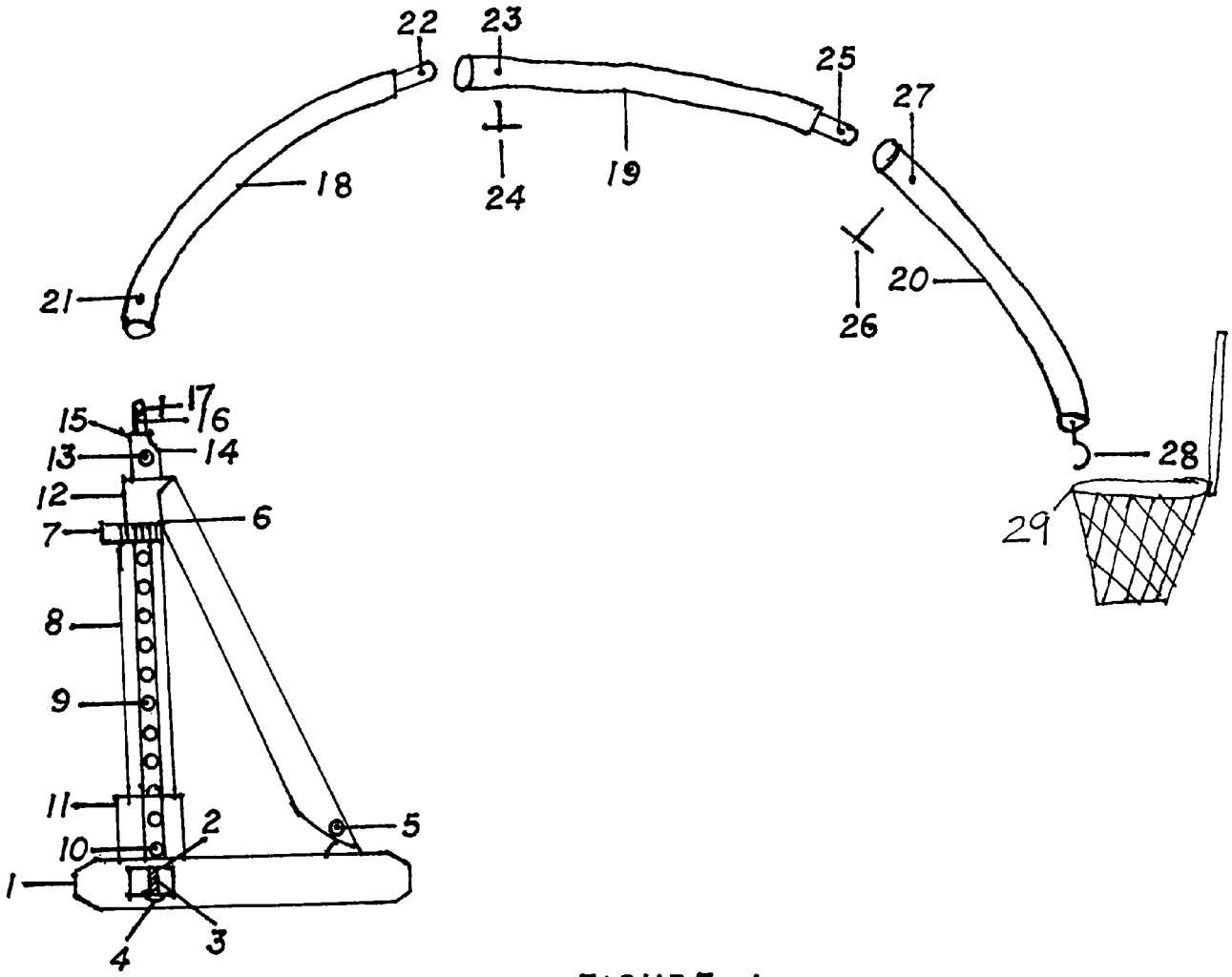
FIG. 1. Is a side view of the base assembly, frame, connector piece and Tubular Arc Guide attached to basketball rim.
Figure 2:
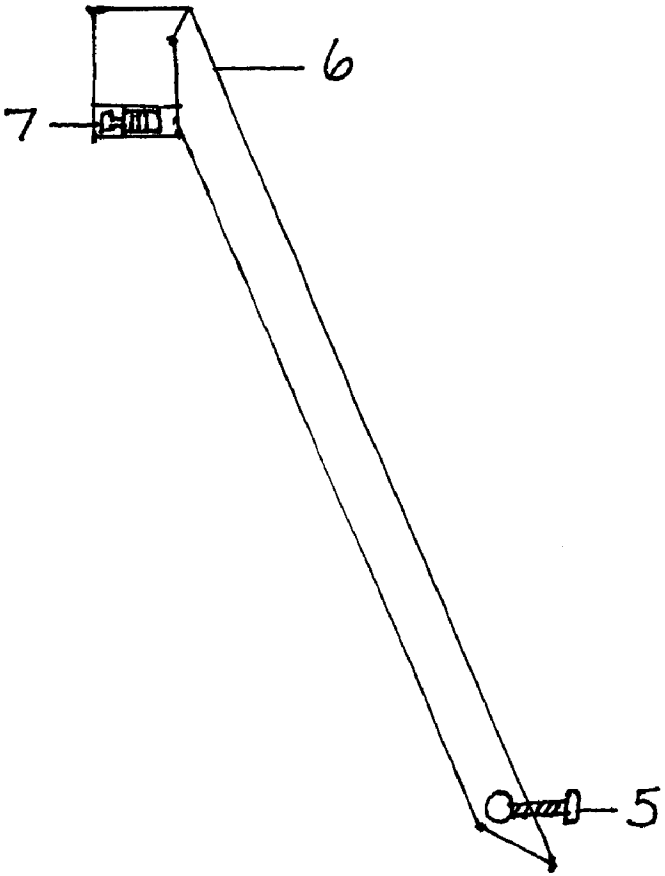
FIG. 2. Is an enlarged side view of the pole cut to size sealed onto the molding taken from FIG. 1.
Figure 3:
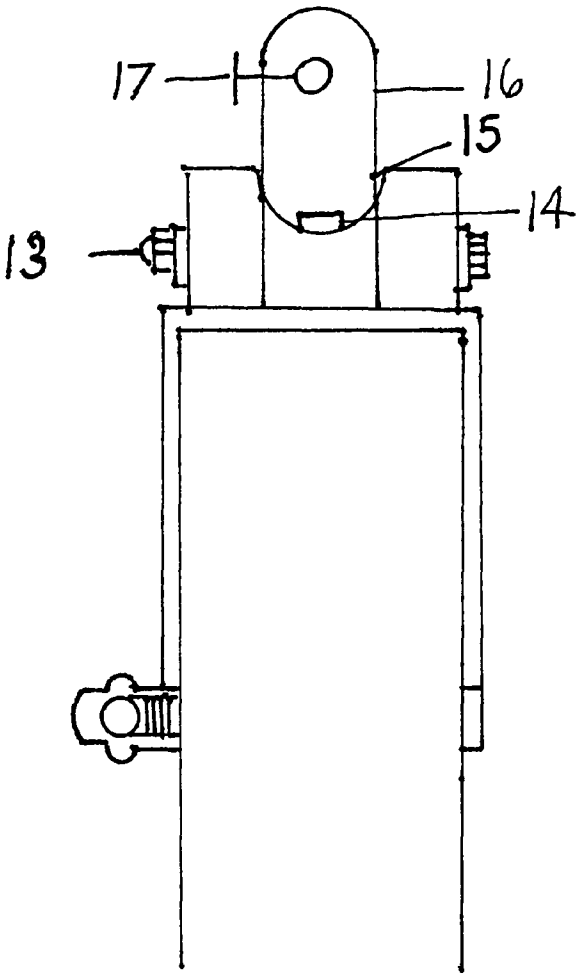
FIG. 3. Is an enlarged front view of the Connector Piece taken from FIG. 1.
Figure 4:
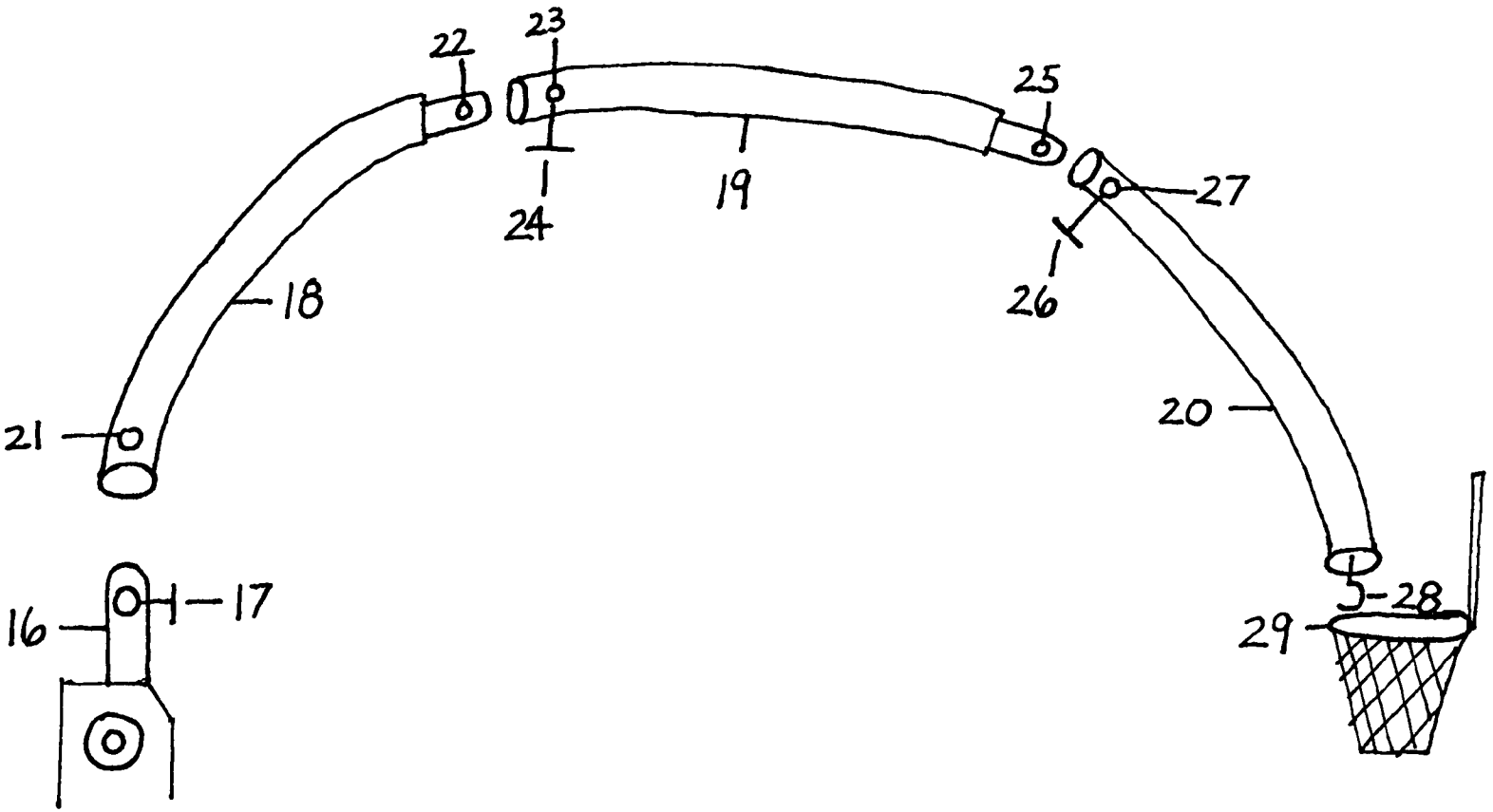
FIG. 4. Illustrates an enlarged side view of the Tubular Arc Guide attached to the basketball rim taken from FIG. 1.

1[.] Base assembly
2[.] Form fitting hole located on the back of base assembly for pole to be inserted
3[.] Metal circular rod attached inside vertical adjustable pole
4[.] Assembly includes alien screw and washer to secure the vertical adjustable pole.
5[.] Hole drilled in protrusion on front part of base assembly includes bolt, washer and nut to hold side pole
6[.] side pole cut to size a molding is formed and attached at one end of the side pole to slide onto the adjustable pole

7[.] Hose clamp wraps around at the bottom of the molding to secure in place.
8[.] Vertical adjustable pole
9[.] Holes on the side of pole to adjust to various height settings
10[.] Metal mechanism used to adjust pole upward or downward
11[.] Metal pipe fits over adjustable pole to stabilize the base assembly
12[.] Inner pole smaller in diameter to fit in vertical adjustable pole to increase the height of the pole
13[.] Hole drilled in the inner pole to hold the connector piece with assembly includes bolt, washers, circular spacers and nut
14[.] Spacer attached inside inner pole in front
15[.] Spacer attached to inner pole behind the connector piece
16[.] Connector Piece
17[.] Threaded hole drilled in the Connector Piece with a thumb screw to stabilize and suspend the Tubular Arc Guide in the air
18[.] First section of the Tubular Arc Guide.
19[.] Second section of the Tubular Arc Guide
20[.] Third section of the Tubular Arc Guide
21[.] Hole drilled through the Tube to connect to the Connector piece
22[.] Connection piece molded at the end of Tubular Arc Guide with a threaded hole drilled through to connect the second section
23[.] Hole drilled through the second tube to attach to the connection piece located at end of the first section
24[.] Thumb screw
25[.] Connection piece molded at end of tubular arc guide with a threaded hole drilled through to connect the third section
26[.] Thumb screw
27[.] Hole drilled through the third tubing to attach to the connection piece located at end of the second section
28[.] metal hook inserted at the tip inside a circular molding
29[.] basketball rim 4 [.]

DETAILED DESCRIPTION OF THE INVENTION

The Magic Arc of includes a base-assembly that is made of lightweight rigid material. The top side of the base-assembly has a form fitting hole located on the back of the base. In front of the base there is a protrusion.

There are two poles made of lightweight material that attaches to the base-assembly to form a solid frame for support. The pole is attached to the protrusion by drilling a hole through the protrusion to connect the pole with a bolt, washer and nut. The pole is to be angled to be perpendicular from the base-assembly.

Towards the top of the side pole it is cut to fit into a molding that slides onto the vertical adjustable length pole. The sturdy molding slides onto and around the vertical adjustable length pole, with a screw hose clamp attached around the bottom of the circular molding.

The vertical adjustable length pole is inserted into the form-fitting hole, located on the back of the base-assembly. The adjustable length pole is secured to the base by an alien screw, located on the bottom of the base that screws into a threaded rod.

The vertical adjustable length pole comprised of two poles. One pole is made slightly smaller in diameter to fit inside of the other pole. This allows the inner pole to adjust in height by sliding the metal mechanism that is attached to the inner pole. By pushing the metal mechanism inward and pushing the inner pole upward simultaneously into the various holes positioned on the side of the outer pole.

Attached to the top of the inner pole section of the vertical adjustable length pole is a connector made from rigid material. The connector is attached via holes drilled through the inner pole and the connector attached by a bolt, washer, circular spacers and nut.

The inner pole can be modified by cutting a U-shape form that will allow the connector to be inserted. A hole must be drilled through the connector to house a thumb screw. Inside the inner pole lie two spacers. The spacers are attached to both sides of the inner pole.

Attached to the connector on the vertical adjustable length pole is a Tubular Arc Guide made from sturdy material, yet flexible in its application. The Tubular Arc Guide is formed into the shape of an arc. Each section has holes drilled on the end enabling thumb screws to attach all sections together by a connecting piece.

At the end of the final piece of the Arc Guide is a metal hook that is inserted at the tip inside a circular mold. The metal hook attaches to the front of the basketball rim.

To secure the base while utilizing the Magic Arc, a metal pipe has been cut to fit over and slide onto the adjustable pole. The metal pipe rest on the top of the base assembly located where the adjustable pole inserts into the hole. This enables the Magic Arc to remain stable on the ground while in use.

What is claim:

1. A basketball shooting aid comprising:

a lightweight, height-adjustable support pole including an upper end and a lower end, a support base assembly attached at a lower end of the support pole;

a tubular guide arc, the tubular guide are formed of a sturdy, yet flexible material, the tubular guide arc including an upper end and a lower end:

a rigid connector piece attached to the upper end of the support pole, the rigid connector piece at a free end including a threaded hole, the rigid connected releasably received within the lower end of the tubular arc:

the tubular guide arc further including a snap-on-device attached at the upper end, the snap-on-device for releasable attachment to a rim of a basketball hoop;

whereby the tubular arc guide is adjustably suspended in the air, wherein the basketball shooting aid provides a basketball player an optimal line of sight to the basketball hoop when shooting a basketball.

2. The basketball shooting aid for claim 1, wherein the tubular guide arc is formed of a plurality of sections, each of said plurality of sections including a threaded hole at a lower end a rigid connecting piece at an upper end, wherein the plurality of sections releasably connect together to form the tubular guide arc.

3. The basketball shooting aid for claim 1, wherein the support pole is cylindrical.

4. The basketball shooting aid for claim 1, wherein the plurality of sections are connected using a thumb screw.

* * * * *